US005902955A

United States Patent [19]

Rossmann

[11] Patent Number: 5,902,955

[45] Date of Patent: May 11, 1999

[54] SABOT FOR A SUBCALIBER PROJECTILE

[75] Inventor: Rudolf Rossmann, Bulach, Switzerland

[73] Assignee: Oerlikon Contraves Pyrotec AG, Zürich, Switzerland

[21] Appl. No.: 08/944,768

[22] Filed: Oct. 6, 1997

[30] Foreign Application Priority Data

Jan. 27, 1997 [CH] Switzerland ..... 19970167/97

[51] Int. Cl.[6] ..... F42B 14/06

[52] U.S. Cl. ..... 102/521

[58] Field of Search ..... 102/520–523

[56] References Cited

U.S. PATENT DOCUMENTS

| | | | |
|---|---|---|---|
| 4,517,899 | 5/1985 | Haberli | 102/521 |
| 4,747,191 | 5/1988 | Montier et al. | 102/521 |
| 5,388,523 | 2/1995 | Rossmann . | |
| 5,404,816 | 4/1995 | Burri | 102/523 |

FOREIGN PATENT DOCUMENTS

| | | | |
|---|---|---|---|
| 3021914 | 9/1983 | Germany | 102/521 |
| 4138598 | 6/1993 | Germany . | |
| 2121146 | 12/1983 | United Kingdom . | |

*Primary Examiner*—Harold J. Tudor
*Attorney, Agent, or Firm*—Browdy & Neimark

[57] ABSTRACT

A sabot body (4) is completely enclosed by the sabot casing (3) which partly also encloses the rear of the pointed projectile (1). The sabot body (4) has the shape of a one-part or multiple-part hollow body with circumferential grooves (5, 34), and an exterior diameter which is smaller than the diameter of the sabot casing. The sabot optimizes gas sealing, reduces weight, and reduces the risk posed by metal splinters.

18 Claims, 3 Drawing Sheets

SABOT FOR A SUBCALIBER PROJECTILE

FIELD OF THE INVENTION

The invention relates to an ejectable sabot for a pointed subcaliber projectile.

REVIEW OF THE RELATED TECHNOLOGY

An ejectable sabot for a pointed subcaliber projectile may have a sabot body in which the pointed projectile is anchored, and a sabot casing encompassing at least a portion of the front end of the pointed projectile and a portion of the sabot body.

In a sabot of this type, both the sabot body and the sabot casing are segmented, which may result in leaks at the contact surfaces of the sabot segments on one hand, and of the pointed projectile and the segments of the sabot body on the other hand.

From EP-A-0 624 774, a sabot of this type is known, in which a special segmentation of the sabot body in the form of longitudinal slits, having at least in part a T-shaped cross-section, is used to eliminate the above-mentioned sealing problems. Furthermore, a gas-tight seal is created by a sealing cap with terminal seal, and rated break points are provided in the area of the inside diameter of the sabot.

This sabot has a relatively complicated design and is therefore rather expensive to manufacture. Also, gas leaks may occur at the location of the joints between the sabot casing and the sabot body. Furthermore, because of the size of the sabot body, the ejection of the sabot during discharge results in relatively large metal splinters.

SUMMARY OF THE INVENTION

The present invention is aimed at designing a sabot of the above type without the above-mentioned drawbacks.

In the present invention, the sabot is fully enclosed by the sabot casing which also partially encloses the rear of the pointed projectile. The sabot body has the shape of a hollow cylinder with circumferential grooves, and a diameter which is smaller than that of the sabot casing.

The sabot according to the invention has the advantage that the complete embedding of the sabot body in a sabot casing made of a synthetic material, produces an optimum seal due to the absence of any metallic surfaces and the prevention of micro-fissures. The sabot body is easy to manufacture and small in comparison to the prior art, resulting in a reduced overall weight of the sabot and smaller and lighter-weight metal splinters produced during the discharge, thus diminishing the danger zone in the vicinity of the muzzle. The rated break points of the sabot are designed so that an easy separation takes place after the discharge. The pointed projectile has only a few catch grooves, resulting in an optimized air resistance profile and relatively low weight reduction.

BRIEF DESCRIPTION OF THE DRAWING

The above and other objects and the nature and advantages of the present invention will become more apparent from the following detailed description of embodiments taken in conjunction with drawings, wherein.

DETAILED DESCRIPTION OF THE PREFERRED EMBODIMENT

Figure 1:
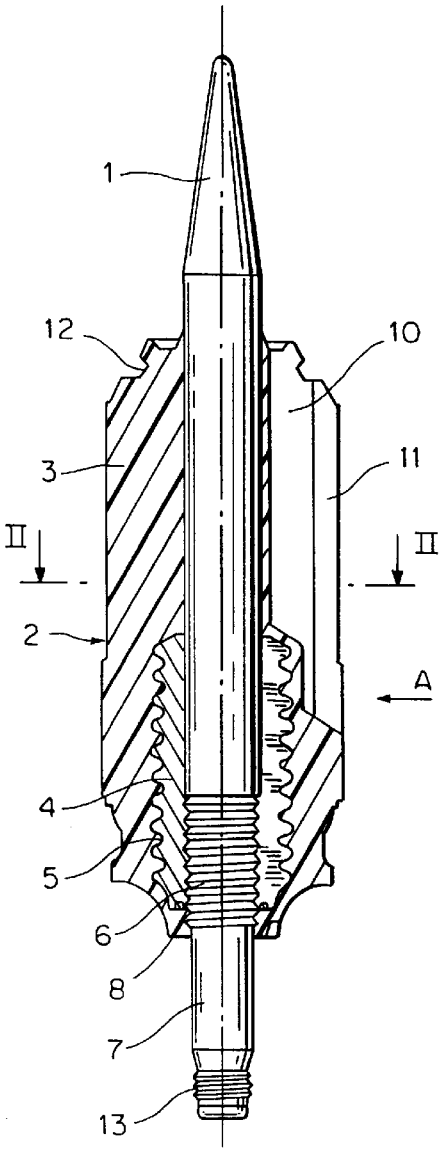
FIG. 1 is a longitudinal cross-sectional view along the line I—I in FIG. 2 through a sabot with pointed projectile according to the invention.
Figure 3:
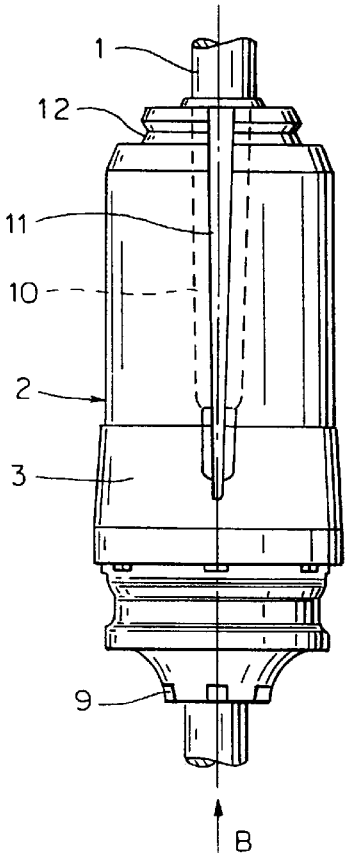
FIG. 3 is a view of the sabot in the direction of the arrow A in FIG. 1.
Figure 2:
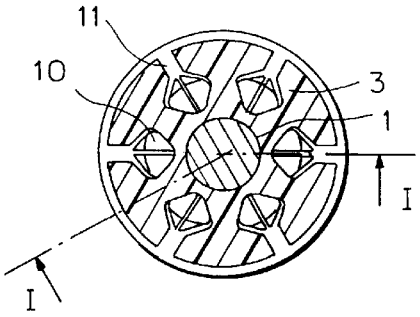
FIG. 2 is a cross-section through the sabot along the line II—II in FIG. 1.
Figure 4:
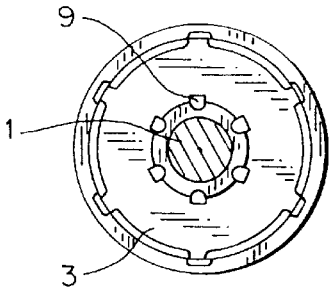
FIG. 4 is a view of the sabot in the direction of the arrow B in FIG. 3.

In FIGS. 1 through 4, the reference number 1 denotes a pointed projectile and the reference number 2 denotes a sabot on the pointed projectile 1. The sabot 2 consists of a sabot casing 3 made of a high-temperature, fiber reinforced thermoplastic synthetic material and a sabot body 4 made of a light metal. The sabot body 4 is completely enclosed by the sabot casing 3, with the sabot casing 3 engaging into circumferential grooves 5 of the sabot body 4 and encompassing a portion of the front and rear of the pointed projectile 1 (projectile front portion and a projectile rear portion). The pointed projectile 1 is secured to the sabot body 4 with a screw connection, wherein the length of a thread 6 of the projectile 1 has been kept short to attain better flight characteristics. The thread 6 protrudes from the sabot body 4 and transitions into a smooth shaft 7 with a smaller diameter, forming a shoulder 8 which is encompassed by the sabot casing 3. The sabot casing 3 has, at its rear portion (rear part, opposite the front part), a plurality of indentations 9 functioning as rated breakpoints. In the front portion of the sabot casing 3, six channels 10 with essentially prismatic cross-sections are equally spaced around the circumference and conically narrow towards the rear. The channels 10 are connected, via casing slits 11 which also conically narrow towards the rear, to the surface of the sabot casing 3, thus forming six segments. It is also possible, however, to design the sabot casing 3 with three, four or five channels 10 and slits 11. The reference number 12 marks a groove used to secure a cap not shown on the drawing. The rear of the pointed projectile 1 has an additional thread 13 to which a stabilizing wing may be attached, which is also not shown on the drawing.

Figure 5:
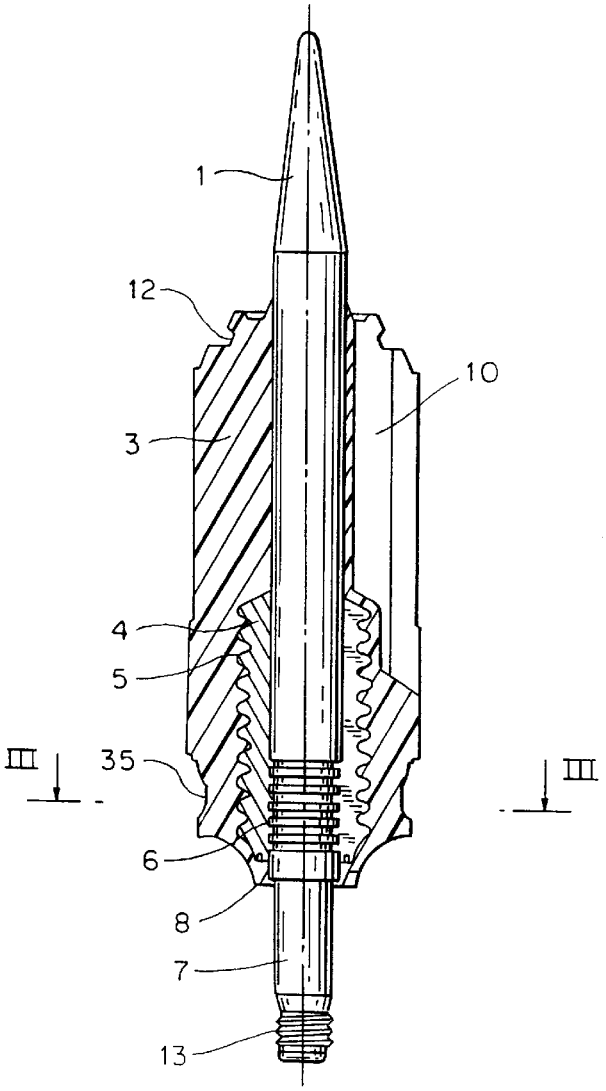
FIG. 5 is a longitudinal cross-sectional view along the line IV—IV in FIG. 6, through a variation of the sabot with pointed projectile according to the invention.
Figure 6:
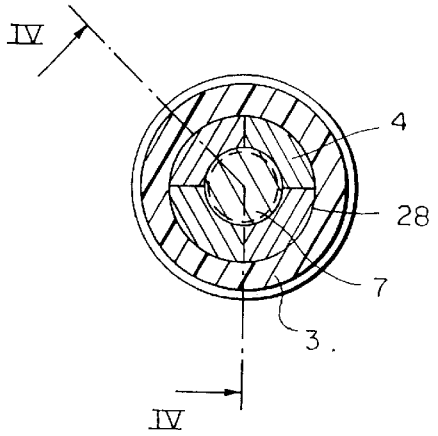
FIG. 6 is a cross-section through the sabot along the line III—III in FIG. 5.

The sabot body 4, as shown in FIGS. 5 and 6, is a multi-part hollow body with an exterior diameter which is smaller than that of the sabot casing 3, comprising segments with circumferential grooves 5. The segments are joined via so-called disconnects 28 and have, at their end sections, an interior toothing to anchor the hollow body that forms the sabot body with its pointed projectile 1. An additional fastening grove 35 is provided in the rear section of the sabot casing 3.

Figure 7A:
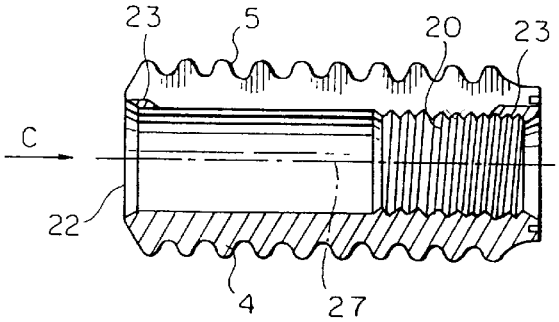
FIGS. 7A and 7B are an enlarged longitudinal cross-sectional view through a sabot body along the line V—V in FIG. 9.
Figure 7B:
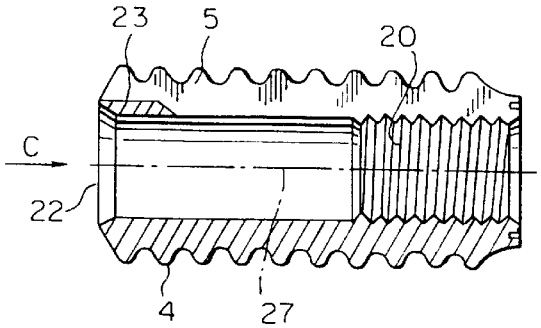
Figure 9:
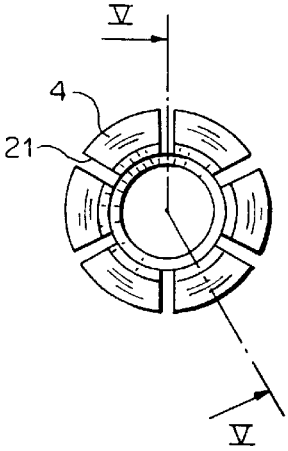
FIG. 9 is a view of the sabot body in its first embodiment in the direction of the arrow C in FIG. 7.

In a further embodiment of the invention illustrated in FIGS. 7A, 7B, and 9 the actual sabot body 4 consists of a hollow cylinder with circumferential grooves 5 and an exterior diameter which is smaller than the diameter of the sabot casing 3. As is visible in FIGS. 7A and 9, the circumferential grooves 5 of the body 4 include wave-shaped, axially-aligned, annular flanges on the sabot body 4 which are interrupted by the body slits 21. The flanges prevent relative axial movement between the sabot casing 3 and the sabot body 4, as illustrated in FIG. 1. The sabot body 4 has, at its rear, an interior thread 20 for a screw connection of the pointed projectile 1. Inside the sabot body 4, six body slits 21 are equally spaced around the circumference, forming six segments extending from the front 22 to the rear of the sabot body 4, where they are delimited by rated break points 23. In further embodiments of the invention, which are not shown on the drawing for ease of viewing, the rated break points 23 are located at the middle section of the slits 21.

Figure 8:
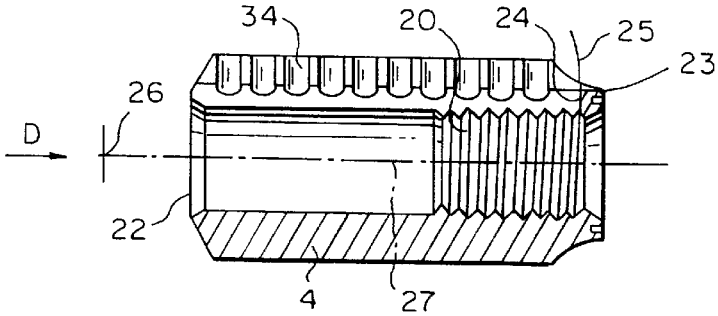
FIG. 8 is an enlarged longitudinal cross-sectional view through a sabot body along the line VI—VI in FIG. 10.

As shown in detail in FIG. 8, the delimiting surfaces 24 of the rated break points 23, for example, are located on the arc of a circle 25 with center of curvature 26 located on the center axis 27 of the sabot body 4. In lieu of six slits 21, the sabot body 4 may also have three, four of five slits 21, resulting in the formation of the same number of segments.

Figure 10:
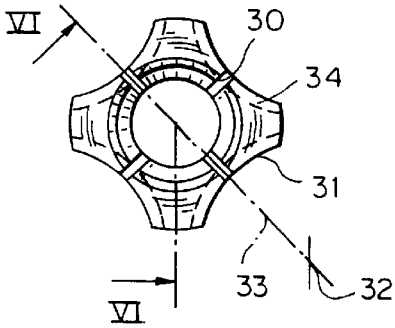
FIG. 10 is a view of the sabot in its second embodiment in the direction of the arrow D in FIG. 8.

In the sample embodiment presented in FIGS. 8 and 10, the sabot body 4 has four slits 30 offset by an angle of 90°. Four circular arc-shaped recesses 31 extend along the entire length of the sabot body 4 in the area of the slits 30, with the center of curvature 32 of the circular arcs located on an axis of symmetry 33 of the slits 30. In other words (as seen in the drawing), the recesses 31 formed on the segments defined by the slits 30 (which extend along the entire length of the body 4), are defined by respective centers (32) of curvature located on a line of symmetry (33) of the body passing through slits (30). The recesses are arcuate in cross section about the centers, which in three dimensions are lines (or axes) while the recesses are generally cylindrical portions. The recesses 31 alone have grooves 34 corresponding to the circumferential grooves 5 of the embodiment shown in FIG. 7A. FIG. 8 shows a longitudinal section through the grooves 34 along the line VI—VI of FIG. 10. This design results in a further significant reduction in weight, along with a further reduction of the risk posed by metal splinters produced after the discharge.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention. Thus the expressions "means to . . . " and "means for . . . " as may be found in the specification above and/or in the claims below, followed by a functional statement, are intended to define and cover whatever structural, physical, chemical or electrical element or structure may now or in the future exist for carrying out the recited function, whether or not precisely equivalent to the embodiment or embodiments disclosed in the specification above; and it is intended that such expressions be given their broadest interpretation.

What is claimed is:

1. A sabot for a pointed subcaliber projectile, the sabot comprising:

a sabot casing (3) and a sabot body (4);

the pointed projectile (1) being anchored in the sabot body (4);

the sabot casing (3) encompassing at least a portion of a front of the pointed projectile (1) and a portion of a rear end of the pointed projectile, and encompassing completely the sabot body (4);

wherein at least a portion of an outer surface of the sabot body (4) and a portion of an inner surface of the sabot casing (3) are in contact along complementary circumferential grooves (5, 34) which are configured to prevent relative axial movement between the sabot casing (3) and the sabot body (4) in both axial directions, and the sabot body (4) comprising a hollow body having an exterior diameter which is smaller than a greatest diameter of the sabot casing.

2. The sabot according to claim 1, wherein the sabot body (4) is one-part.

3. The sabot according to claim 1, wherein the sabot casing (3) is divided into casing segments with a plurality of channels (10), the channels having a substantially prismatic cross-section and being substantially equally spaced circumferentially on a front part of the sabot casing (3), the channels conically narrowing towards a rear part of the sabot casing (3).

4. The sabot according to claim 3 wherein the channels (10) are connected to a surface of the sabot casing (3) via casing slits (11), the casing slits (11) conically narrowing towards the rear part of the sabot casing.

5. The sabot according to claim 4 wherein the sabot casing channels (10) and casing slits (11) number three, four or six.

6. The sabot according to claim 1, wherein the sabot body (4) is divided into body segments, and wherein the sabot body (4) includes a plurality of body slits (21) forming the body segments, the body slits being spaced substantially equally around a circumference and extending from a sabot body front (22) to a sabot body rear.

7. The sabot according to claim 6, wherein the body slits (21) are delimited by rated break points (23).

8. The sabot according to claim 7, wherein the break points (23) are disposed at the sabot body rear.

9. The sabot according to claim 7, wherein the break points (23) are disposed at the sabot body front.

10. The sabot according to claim 7, wherein the break points (23) are disposed at both the sabot body front and the sabot body rear.

11. The sabot according to claim 7, wherein delimiting surfaces (24) of the rated break points (23) are located on an arc of a circle (25) with center of curvature (26) located on the center axis (27) of the sabot body (4).

12. The sabot according to claim 6, wherein the sabot body (4) includes six body slits (21) offset by an angle of substantially 90°.

13. The sabot according to claim 6, wherein the sabot body (4) includes four body slits (30) offset by an angle of substantially 90°.

14. The sabot according to claim 1, wherein the sabot body (4) includes a plurality of body slits (30) forming the body segments, the body slits being spaced substantially equally around a circumference and extending from a sabot body front to a sabot body rear;

the body segments including respective recesses (31) extending along an entire length of the sabot body (4), each of the segments in cross section including a respective center (32) of curvature located on a line of symmetry (33) of the body passing through slits (30).

15. The sabot according to claim 14, wherein the circumferential grooves (34) are formed exclusively in an area of the recesses (31) extending along the entire length of the sabot body (4).

16. The sabot according to claim 1, wherein the sabot body (4) comprises a multi-part catch part in segment form anchored to the pointed projectile (1), wherein individual segments thereof are connected to one another via separating surfaces (28) and wherein the segments include a plurality of circumferential grooves (5) equally spaced around the circumference.

17. The sabot according to claim 1, wherein the complementary circumferential grooves comprise generally axially-aligned annular flanges on the sabot body.

18. The sabot according to claim 17, wherein the axially-aligned annular flanges on the sabot body are interrupted by body slits (21).

* * * * *